United States Patent [19]

Stillhard

[11] 3,954,046

[45] May 4, 1976

[54] VALVE ARRANGEMENT FOR CONTROLLING A REVERSIBLE HYDRAULICALLY OPERATED DEVICE

[75] Inventor: Bruno Stillhard, St. Gallen, Switzerland

[73] Assignee: Gebruder Bühler A.G., Switzerland

[22] Filed: Mar. 13, 1974

[21] Appl. No.: 450,799

[30] Foreign Application Priority Data

Mar. 14, 1973 Switzerland ..... 3628/73

[52] U.S. Cl. ..... 91/361; 91/420; 91/446; 91/457; 91/461

[51] Int. Cl.[2] ..... F15B 13/16; F15B 13/043

[58] Field of Search ..... 91/457, 461, 306, 420, 91/361

[56] References Cited

UNITED STATES PATENTS

| | | | |
|---|---|---|---|
| 1,066,289 | 7/1913 | Kolomyjski | 91/457 |
| 1,073,954 | 9/1913 | Burns | 91/457 |
| 2,423,393 | 7/1947 | Lauck | 91/457 |
| 2,671,433 | 3/1954 | Meddock | 91/457 |
| 2,672,731 | 3/1954 | Ashton | 91/461 |
| 2,685,342 | 8/1954 | Lauck | 91/457 |
| 3,296,941 | 1/1967 | Rochte | 91/306 |

*Primary Examiner*—Paul E. Maslousky
*Attorney, Agent, or Firm*—McGlew and Tuttle

[57] ABSTRACT

The valve arrangement includes four main control valves connected in a bridge circuit connected, at one end of a first diagonal, to a source of fluid under pressure and, at the other end of the first diagonal, to a fluid reservoir. Opposite ends of a second diagonal of the bridge are connected to inlet and outlet ports of the operated device. The arrangement includes two pressure adjusting valves, each connected to a respective pair of main control valves. In one bridge circuit, the main control valves are pressure limiting valves and each pair of main control valves includes one main control valve in one branch of the bridge circuit and another main control valve in the other branch of the bridge circuit. In a second bridge circuit, the main control valves adjacent the connection to the source of fluid under pressure are pressure reducing valves, and the main control valves adjacent the connection to the reservoir are pressure limiting valves, with each pair of main control valves including a pressure reducing valve and a pressure limiting valve forming a bridge branch. In the second bridge circuit, pilot-controlled check valves are included in the connections to the operated device. The pressure adjusting valves are electrohydraulic valves continuously adjustable between the closed and the fully open position and each associated with a respective potentiometer for adjusting its exciting current.

12 Claims, 9 Drawing Figures

I

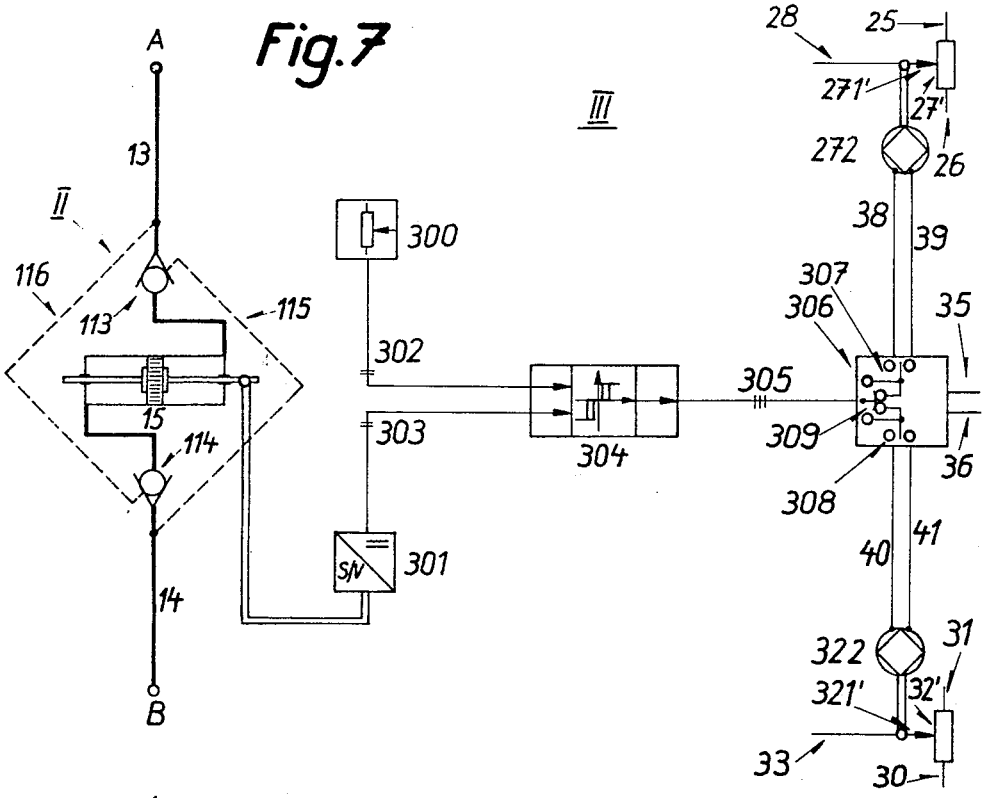
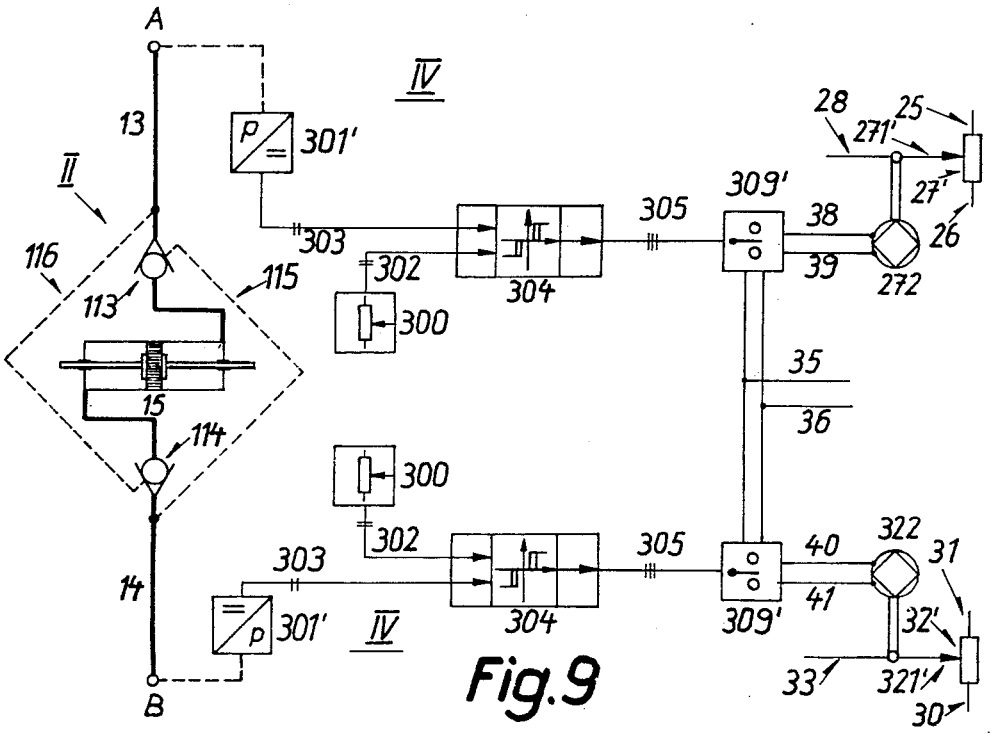
Fig.9

VALVE ARRANGEMENT FOR CONTROLLING A REVERSIBLE HYDRAULICALLY OPERATED DEVICE

FIELD AND BACKGROUND OF THE INVENTION

The present invention relates to a valve arrangement for controlling a hydraulically operated device, comprising four main control valves mounted in a bridge connection, one end point of a first diagonal of the bridge being connected to a pressure-fluid source, the other end point of the first diagonal of the bridge being connected to a storage tank, one end point of a second diagonal of the bridge being connected to the input and the other end point of this diagonal to the output of the hydraulically operated device, and a respective common pilot control being associated with each set of two of the valves for determining the direction and magnitude of the hydraulic pressure.

Control valve arrangements with check valve mechanisms cooperating in a bridge circuitry are well known. It is also known to control such valve mechanisms with the aid of a pilot slide valve whose sliding member is electromagnetically displaceable between a rest position and a plurality of operating positions. Depending on this control motion of the sliding member, communication is selectively established between one of the connections of the operated device and the associated supply check valve as well as between the other connections thereof and the associated return check valve in accordance with the desired flow direction, and a rate of flow of the pressure fluid necessary for the performance of a working step in the respective direction is adjusted in a special bypass valve mounted upstream of the bridge.

At the same time, a speed control is effected at the upstream side with the aid of the respective return check valve by bringing the latter into a metering position limiting the outflow of pressure fluid from the operated device as a function of the corresponding operational position of the sliding member also determining the adjustment of the bypass valve.

In the known arrangements, the pilot slide valve must have a certain minimum length, because of the plurality of required operational positions. The length is, in any case, sufficient to produce frictional losses or hysteresis effects which are unavoidable in view of the small manufacturing tolerances necessary for a quality control and which affect the sensibility, rapidity and accuracy of the response.

A precision machining of the great number of grooves, metering notches and slots, with which the pressure-fluid volume passing through the pilot, bypass, and return check valves must be controlled, is highly expensive. Moreover, in spite of the precision in manufacture, the thus metered flow is subjected to variations which frequently require special preventive measures in the construction, requiring additional equipment.

SUMMARY OF THE INVENTION

The present invention is directed to the problem of providing a simple valve arrangement, of the type mentioned in the beginning, in which such drawbacks are eliminated.

In accordance with the invention, the pilot control equipment is provided in the form of two pressure adjusting valves each connected to control lines of two main control valves.

The separate pilot control of each of the two sets or pairs of two main control valves by means of a respective associated pressure adjusting valve makes it possible to produce an exact working motion in the operated device against a certain counter-pressure. Also, the main control valves determine the direction and the pressure or velocity of the pressure fluid supplied to the operated device, without the use of a special by-pass valve.

Consequently it becomes possible to operate a hydraulic device by the difference of two pressures of different magnitudes opposed to each other and acting on the device simultaneously from both sides.

According to the different requirements in service, two different kinds of pilot control may be provided by choosing two different types of valves as the main control valves.

In case, for example, that the operated device has to perform work in only one direction and the respective back motion is effected in a separately controlled idle phase, the main control valves advantageously may be provided in the form of pilot controlled pressure limiting valves.

Due to a common pilot control of each set of two such valves, mounted in opposite branches of the bridge, the pressure or flow velocity of the pressure fluid can be controlled separately in the two directions. This permits an exactly controlled working motion of the operated device which, at its input side, is constantly under the system pressure opposed by a varying counter-pressure of the outflowing pressure fluid at the output side.

If respective different performances are required of the operated device alternately in the two working directions, pilot controlled pressure reducing valves advantageously may be used as the main control valves in the two bridge arms which are directly adjacent the pressure-fluid supply line while the main control valves in the other two arms of the bridge, which are adjacent the back-flow or return line, are still pilot-controlled pressure limiting valves.

Such a valve arrangement is capable of coping with high rates of flow at high pressures.

The pressure, once adjusted by means of the pilot control, is automatically maintained constant by the pressure reducing valves. At any failure of the pilot control, the pressure reducing valves close so that the pressure in the supply system is kept at the operation level. This is particularly useful if a plurality of operated devices is to be supplied.

By providing biasing springs with spring constants which are different for the pressure reducing and the pressure limiting valves, the advantage is obtained that, at any adjusted operational pressure, the pressure limiting valve at the input side remains securely closed and prevents a pressure loss.

The common pilot control of a pressure reducing valve and a pressure limiting valve mounted in series in a bridge branch, in accordance with the invention, offers the possibility of adjusting two mutually independent pressures $P_A$ and $P_B$ of any magnitude in the connections A and B, acting on the operated device from opposite sides. Consequently a pressure difference $\Delta p = P_A - P_B$ becomes effective in the operated device, whose direction is reversible with the sign of the difference $P_A - P_B$. The pressure difference $\Delta p$ can be varied in both directions between zero and the system pressure with the result of a rapid and accurate adjustment of the position or working speed of the operated device.

The use of the two above mentioned types of main control valves has further advantages. Since there are no actuating pistons or metering notches and slots, the manufacture of the valves is less expensive and the metered flow is free from variations so that additional measures are superfluous. Pressure excess and cavitation are compensated automatically without special safety valves.

Pilot controlled check valves, of which one may be mounted in each connection line between the junctions A and B and the respective output or input of the operated device, prevent any working motion under any load when the operated device is in its rest position, i.e. when $P_A = P_B$. As soon as the device is put into operation, the respective check valve mounted at the input side is opened by the operational pressure $P_A$ or $P_B$ adjusted in the respective connection A or B. The venting of the check valve at the respective outlet side is effected simultaneously by a pressure difference resulting from the same respective operational pressure $P_A$ or $P_B$ applied to the valve through its control line leading from the connection A or B and the pressure at the outlet of the operated device.

The most suitable means for the pilot control of main control valves are electrohydraulic pressure-control valves which are continuously adjustable with a very small susceptibility to hysteresis or oscillations and have a minimum throughput of pressure fluid. The strict proportionality between the pressure and the exciting current, along with a satisfactory reproducibility of the pressure values results in a linear control characteristic of the inventive valve arrangement. Its application also permits controlling the pressures to follow any desired characteristic, largely adapted to the operational requirements in each case.

The two potentiometers serving to control the exciting current supplied to these pressure-control valves can be adjusted both individually and conjointly through a corresponding coupling mechanism. If two identical conventional motor potentiometers are provided, whose motors are mounted in parallel and fed with the same control voltage, an advantageous electric coupling is obtained so that, if needed, their synchronism is insured.

The mutual position of the potentiometer sliders within a mechanical or electric coupling may be predetermined so that if one of the sliders is in its starting position at the limit having the highest electric potential, the other slider is positioned at the limit having the lowest electric potential and, in the course of their antiparallel displacement, the two sliders pass through the midpoints of the respective control ranges of the potentiometers simultaneously.

In reversing operations using a bridge comprising two pressure reducing and two pressure limiting valves, in accordance with the invention, such a coupling of potentiometer slides makes it possible to continuously control the differential pressure $\Delta p$ driving the operated device along a straight characteristic passing centrally through the zero pressure level and extending, in both motion directions, up to the level of the system pressure.

If a limitation of the pressure $\Delta p$ effective in the operated device is needed for operational reasons, such a limitation can be obtained simply by changing the mutual position of the potentiometer sliders.

The sliders are first brought into their initial positions at the respective limiting position having the highest or the lowest potential, and one of the sliders then is displaced into any other initial position having a different potential relative to the limit at which the other slider remains positioned. In consequence, in the course of their antiparallel displacement, the two sliders reach the midpoint of the control range at different points of time. The control range for $\Delta p$ thereby is shortened symmetrically with respect to the two motion directions and proportionally to the displacement of the slider.

If a separate control of the operated device in the two directions is desired, the two potentiometers can, of course, be operated separately. Furthermore, the inventive arrangement, with two pressure reducing and two pressure limiting valves, makes it possible to vary a differential pressure $\Delta p$, in the operated device, following a characteristic of any desired shape, by remotely controlling the exciting currents of the electrohydraulic pressure-control valves in accordance with separate programs for each bridge branch.

In a further development of the invention, the valve arrangement, particularly the embodiment with two pressure reducing valves and two pressure limiting valves, is advantageously usable as a final control element of electrohydraulic control circuits.

Such a final control element may be designed as an independent control circuit, in which case additional components are to be inserted in accordance with the signal flow. These include a set value transmitter, for the excitation of the electrohydraulic pressure-control valves, to which excitation the differential pressure $\Delta p$, resulting from the pressures $P_A$ and $P_B$ in the connections A and B is also proportional, and a position or speed transmitter coupled with the operated device, as well as a controller for comparing the signals coming from the transmitters and automatically effecting a corresponding adjustment of the potentiometer drives.

By means of a selector switch mounted after the output of the controller, a separate control of the two potentiometers is made possible.

To obtain an automatically working, reversibly operable arrangement permitting the supplying of the operated device with a differential pressure $\Delta p$ which, in accordance with a characteristic of any desired shape, is adjustable by means of two independently controlled branches of a bridge circuit comprising two pressure reducing valves and two pressure limiting valves, each of the two bridge branches is advantageously designed as a separate electrohydraulic control circuit. In such a case, the above mentioned component parts must be provided in each of the two control circuits, and the actual-value transmitters necessary for the pressure control are advantageously pressure sensors each associated with one of the connections A and B.

For an understanding of the principles of the invention, reference is made to the following description of typical embodiments thereof as illustrated in the accompanying drawings.

BRIEF DESCRIPTION OF THE DRAWINGS

In the Drawings:

FIG. 7 is a block diagram of an electrohydraulic control circuit with a linear control characteristic, which can be adapted from the bridge circuit shown in FIG. 2;

FIG. 9 is a block diagram of two electrohydraulic control circuits having a $\Delta p$-control characteristic of any desired shape and adapted from a bridge circuit of the type shown in FIG. 2.

DESCRIPTION OF THE PREFERRED EMBODIMENTS

Figure 1:
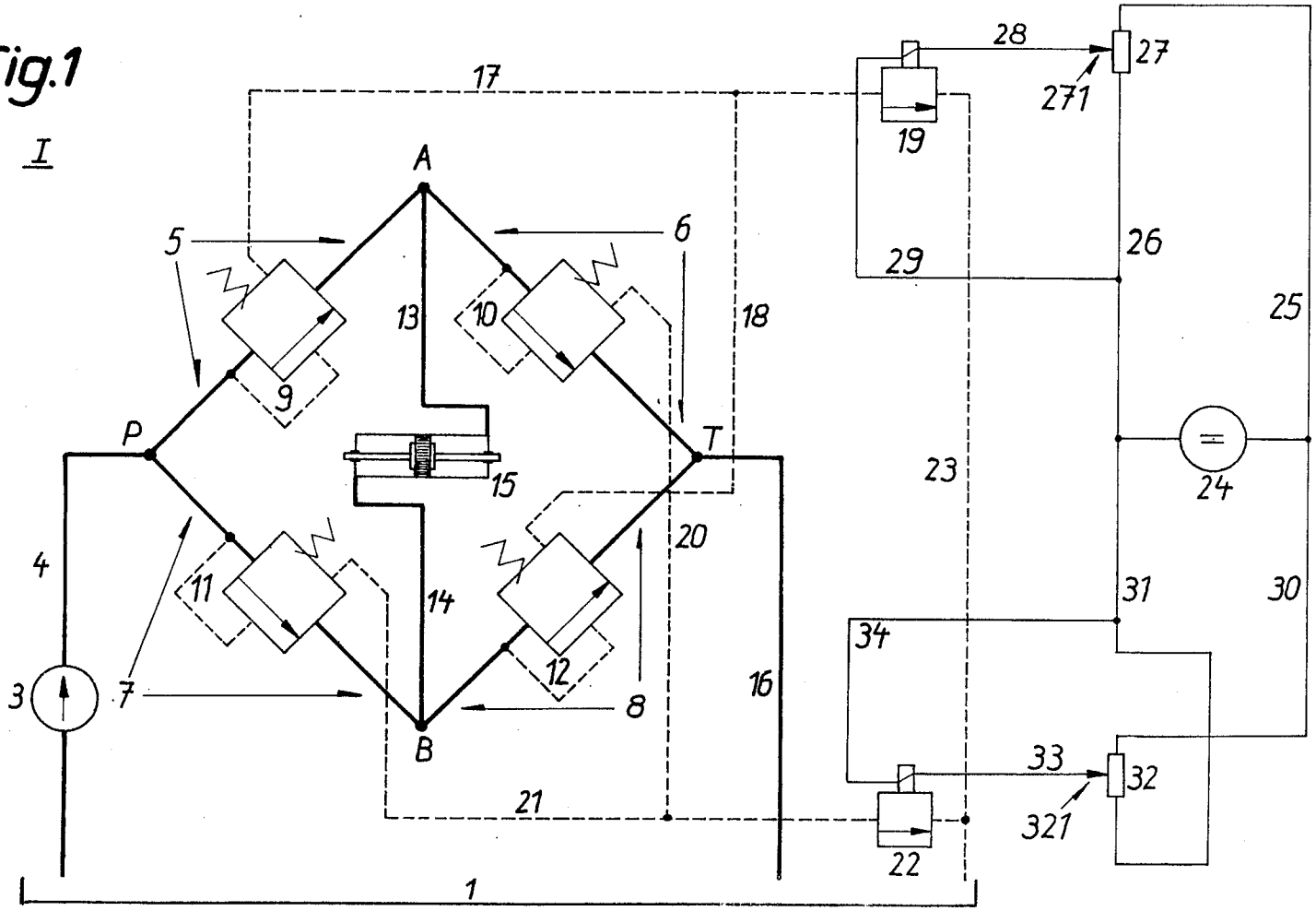
FIG. 1 is a block diagram of a first bridge circuit with main control valves designed as pressure limiting valves.
Figure 3:
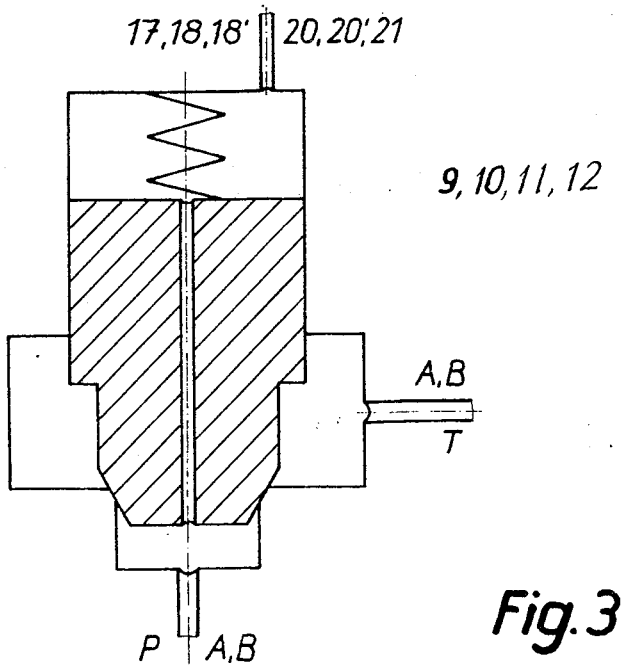
FIG. 3 is a diagrammatic view of a pressure limiting valve.

In the first valve arrangement, illustrated in FIG. 1, the pressure fluid is applied, by means of a pump 3, from a storage tank 1 through a suction line 2 into a pressure-fluid supply line 4 and through an inlet P, located at an end point of the horizontal or first diagonal of the bridge, into a valve bridge circuit I. Main control valves 9, 10, 11, 12, designed as pilot controlled pressure-limiting valves according to FIG. 3, are mounted in each of the arms 5, 6, 7, 8, respectively, of the bridge circuit I. A reversibly operable hydraulic device 15 is connected, by means of two pressure lines 13, 14, between two connections A and B provided at the two opposite end points of the vertical or second diagonal of the bridge. The pressure fluid leaving the bridge circuit I passes through the outlet T, provided at the second end point of the first diagonal of the bridge, and through a return line 16 to the storage tank 1.

For a common pilot control, the valves 9 and 12, as well as 10 and 11, are combined to respective pairs of main control valves. The two valves 9, 12 are associated, through respective control lines 17 and 18, each is connected to one of the valves 9, 12, with a pressure adjusting valve 19, designed as an electrohydraulic pressure-control valve, while the two valves 10, 11 are analogously pilot-controlled, through two further control lines 20, 21, each connected to a respective one of the valves, by a separate pressure adjusting valve 22, also designed as an electrohydraulic pressure-control valve. The pressure fluid returns into the storage tank 1 through a return line 23 communicating with the two pressure adjusting valves 19, 22.

A d.c. electric potential source 24 supplies the electric energy for the excitation of the pressure adjusting valves 19, 22, i.e. the electrohydraulic pressure-control valves. Through two lines 25, 26, voltage is applied from source 24 to a potentiometer 27 associated with valve 19 and including a slider 271 which is connected, through a line 28, to the input terminal of the magnetizing winding of valve 19. Another line 29 connects the output terminal of the magnetizing winding to the line 26.

Two further lines 30, 31, connected in parallel to the lines 25, 26, apply voltage to another potentiometer 32 associated with valve 22. The circuit of the magnetizing winding of valve 22 includes the slider 321 of the potentiometer 32, a line 33 leading to the input terminal, the winding, the output terminal, and a line 34 leading to the line 31.

The arrangement shown in FIG. 1 operates in the following manner. If, by a corresponding adjustment, for example, of potentiometer 32, a definite limit-response pressure $P_{BL}$ for the pair of main control valves 10, 11 is predetermined in pressure adjusting valve 22, and this limit pressure exceeds the system pressure $P_S$, a continuous control of the fluid pressure or the fluid flow velocity, operating the device 15, is made possible in the direction from A to B and within a range between zero and a maximum value corresponding to the system pressure $P_S$. This control is effected by a continuous presetting, in pressure adjusting valve 19, of the desired values between $P_{A_L} = P_S$ and zero for the other pair of main control valves 9, 12, by means of potentiometer 27. Analogously for reversing the flow in the operated device 15, i.e. for directing the fluid flow from B to A, a definite limit pressure $P_{A_L} = P_S$ is predetermined in pressure adjusting valve 19, for the pair of main control valves 9, 12, by means of potentiometer 27 and the desired values between $P_{B_L} = P_S$ and zero for the other pair of main control valves 10, 11 is continuously preset in pressure adjusting valve 22 by potentiometer 32. The respective value of $P_{A_L}$ or $P_{B_L}$ is determined for the pressure which must be built up by the pressure fluid leaving the operated device 15 for clearing the return path, i.e. opening the respective main control valve 10 or 12 at the outlet side. Since a main control valve 9 or 11 of the pressure limiting type mounted at the inlet side and pilot-controlled by pressure values $P_{A_L} \leq P_S$ or $P_{B_L} \leq P_S$ opens in any case completely, the system pressure $P_S$ is always fully effective in the respective connection A or B. Consequently, in this case, operated device 15 is exposed to a residual pressure which is the remaining portion of the system pressure $P_S$ after surmounting the limit response pressure $P_{A_L}$ or $P_{B_L}$ in the respective main control valve 10 or 12 at the outlet side, which is also of the pressure limiting type.

Figure 2:
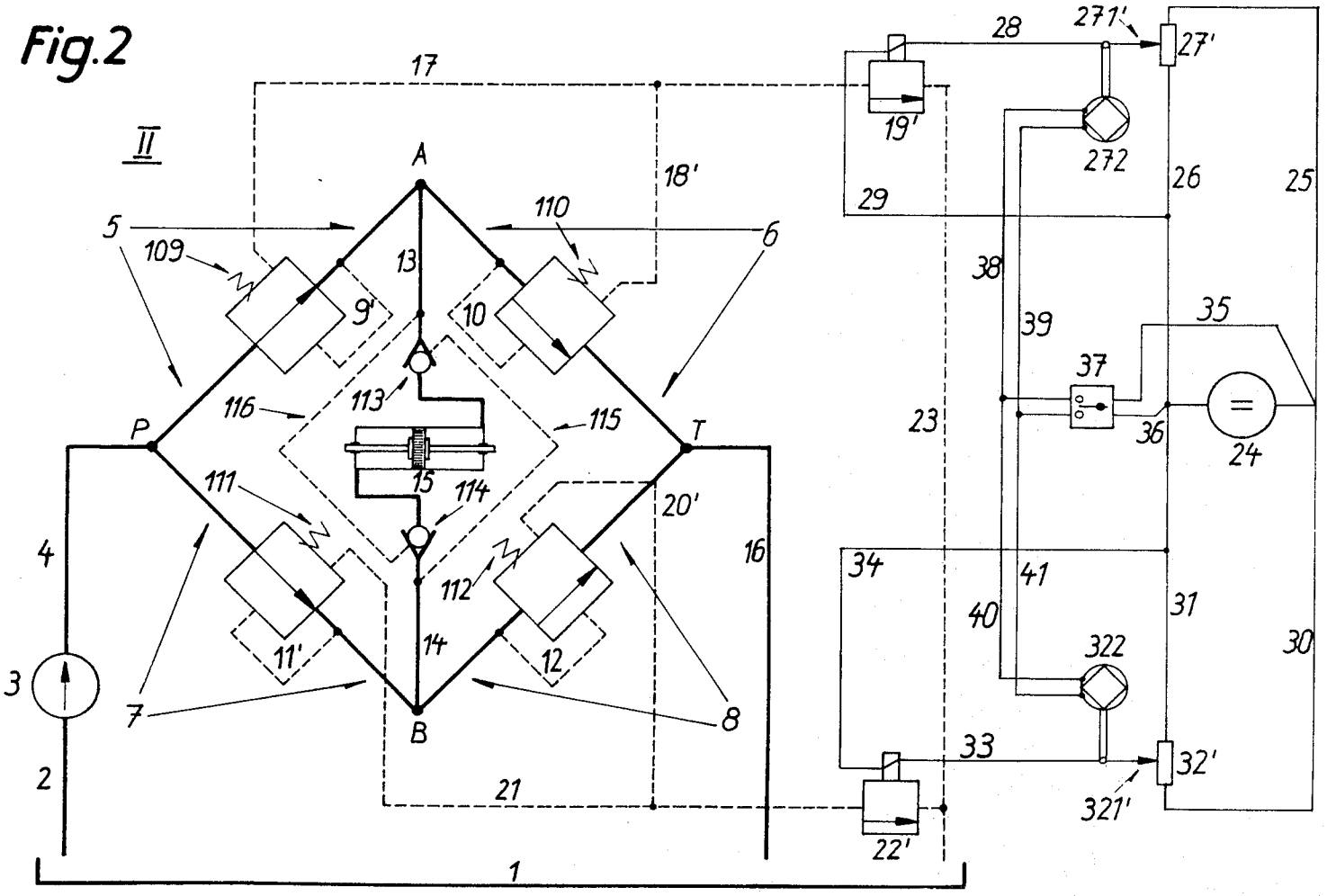
FIG. 2 is a block diagram of a second bridge circuit comprising two pressure reducing valves and two pressure limiting valves as main control valves.

The second valve arrangement, shown in FIG. 2, comprises many details which are similar to the first arrangement of FIG. 1. The same or analogous elements are designated by the same reference characters and, as far as some particularities are concerned, the description of the first arrangement illustrated in FIG. 1 is to be considered.

Figure 4:
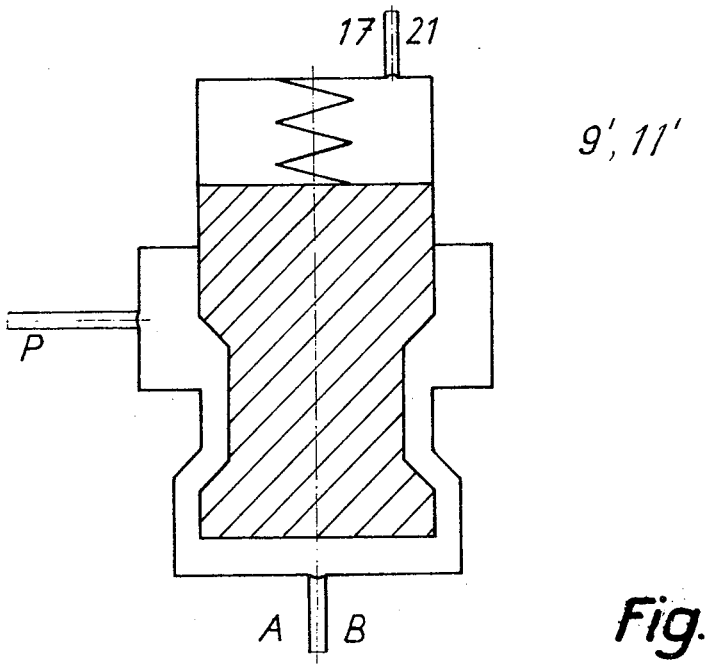
FIG. 4 is a diagrammatic view of a pressure reducing valve.

The main control valves 9′ and 11′, mounted in the arms 5 and 7 of the valve bridge circuit II represented in FIG. 2, comprises pilot-controlled pressure reducing valves, such as shown in FIG. 4. The other main control valves 10, 12, mounted in the bridge arms 6, 8 are, as before, pilot-controlled pressure limiting valves such as shown in FIG. 3. The valves 9′ and 11′ are biased by springs 109, 111 having a smaller spring constant than the springs 110, 112 biasing the valves 10, 12. For example, the difference may be so provided that, while the springs 109, 111 yield already to a pressure of 3 kp/cm², the compression of the springs 110, 112 requires a pressure of 7 kp/cm².

Respective pilot-controlled check valves 113 and 114 are mounted in the connection lines 13, 14, the check valve 113 communicating through control line 115 with the connection B and the check valve 114 through a control line 116 with the connection A.

For a common pilot control, the valves 9', 10 and 11', 12 forming the two bridge branches 5, 6 and 7, 8, respectively, are associated with each other as pairs of main control valves. By means of two control lines, of which the first line 17 is connected to the valve 9' in the same manner as in the bridge circuit of FIG. 1 while the second line 18', in this arrangement, is connected to the valve 10, the pair of valves 9', 10 is pilot-controlled by a pressure adjusting valve 19' designed as an electrohydraulic pressure-control valve. Through two further control lines, of which the first line 20', in this case, is connected to the valve 12 while the second line 21, as in FIG. 1, is connected to the valve 11', the pair of valves 11', 12 is associated with a pressure adjusting valve 22' designed as an electrohydraulic pressure-control valve.

Figure 5:
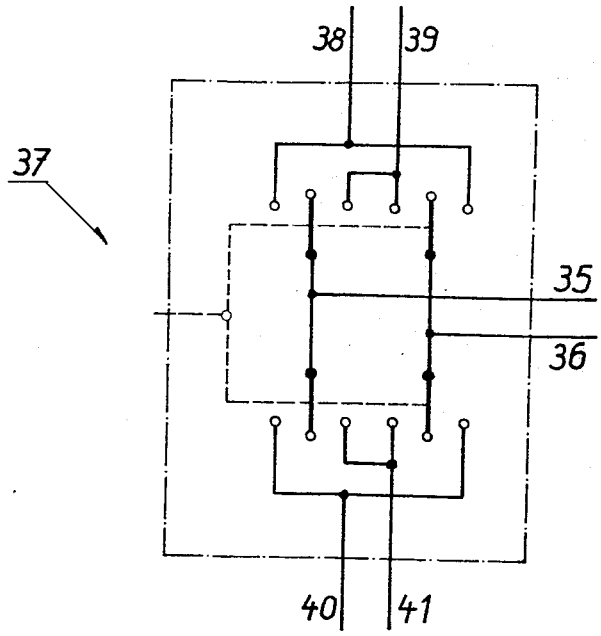
FIG. 5 is a circuit diagram of a reversing switch permitting a reversible parallel operation of two motor potentiometers for controlling the variation of the pressures $P_A$, $P_B$, and $\Delta p$ in a bridge designed in accordance with FIG. 2.

For measuring out the exciting current for the valves 19' and 22', respective motor potentiometers 27' and 32' are used. Their respective sliders 271' and 321' are connected to the magnetizing windings of the values 19' and 22' respectively, through the same lines 28 and 23 as in the arrangement of FIG. 1. The sliders 271', 321' are displaced by means of associated drive motors 272, 322 connected thereto. The motors are supplied from voltage source 24 through two lines 35, 36, a common reversing switch 37, shown in FIG. 5, and individual connection lines 38, 39 and 40, 41. This circuitry insures a rigid electric coupling of the two sliders 271' and 321'.

In the unexcited or unenergized state, that is when the respective energizing currents $I_{19}$ or $I_{22}$ are zero, the respective electrohydraulic control valves 19' or 22' are fully open and permit an unchoked outflow of the pressure fluid from the control pressure spaces of the connected main valves 9', 10 or 11', 12, respectively, which are pilot-controlled. When the respective energizing currents $I_{19}$ or $I_{22}$ attain the maximum value $I_{max}$, control valves 19' or 22' are closed, and the pressure fluid is kept blocked in the control pressure spaces of main valves 9', 10 or 11', 12, respectively.

In any value of the respective energizing currents $I_{19}$ or $I_{22}$ between O and $I_{max}$, control valves 19', 22 are opened to an extent determined by the respective degree of excitation, resulting in a correspondingly choked outflow of the pressure fluid from the control pressure spaces of the associated main valves 9', 10 or 11', 12, respectively. When not subjected to fluid pressure, main valves 10 and 12, which are pressure limiting valves such as shown in FIG. 3, are kept closed by return springs 110, 112, respectively. In contrast thereto, and when not subjected to pressure, main valves 9', 11', which are pressure reducing valves as shown in FIG. 4, are fully opened under the action of the respective return springs 109 and 111.

As long as the control pressure space of a pressure limiting valve 10 or 12 is closed because the associated control line 18' or 20' is blocked by the respective pressure control valve 19' or 22', the valve body of the pressure limiting valve can not be lifted from its seat by any pressure supplied to connections A or B, and the valve remains closed. It is only after the pressure fluid starts to flow out from the control pressure space that a differential pressure is built up, through the choked central bore of the valve body shown in FIG. 3, and the valve body can be lifted from its seat to a certain extent until the force of the compressed spring 110 or 112, respectively, along with the pressure in the control space, is able to equilibriate the differential pressure. Simultaneously, the pressure at the connections A or B is continuously limited to the adjusted value. With the associated pressure control valve 19' or 22' blocked, the control pressure space of a pressure reducing valve 9' or 11', connected through the associated control line 17 or 21, is also closed.

A pressure supplied through connection P but also building up in the open valve on the pressure surface opposite to the valve outlet A' or B' cannot displace the valve body toward the valve seat, and the valve remains fully open. Only after the associated pressure control valve 19' or 22' has been unblocked by changing its degree of excitation, the starting outflow of pressure fluid from the control pressure space of the pressure reducing valve 9' or 11' again permits a differential pressure to build up between the pressure surfaces on opposite sides of the valve body. The differential pressure presses the valve body toward the valve seat until an equilibrium is eatablished with the combined spring force and pressure in the control pressure space. For the operated device 15, a correspondingly reduced pressure is continuously available at the valve outlet A or B.

Through control line 17', 18' or 20', 21, respectively, conjointly connected to pressure control valves 19' or 22', a simultaneous and identical pressure variation is assured in the control pressure spaces of the valve pairs, each pair comprising a pressure reducing valve 9' and a pressure limiting valve 10 or a pressure reducing valve 11' and a pressure limiting valve 12, respectively, so that choking bores in the valve bodies of pressure reducing valves 9' and 11' are superfluous. This measure not only means a simplification but also contributes substantially to uniform control of the valves of each pair.

Figure 6:
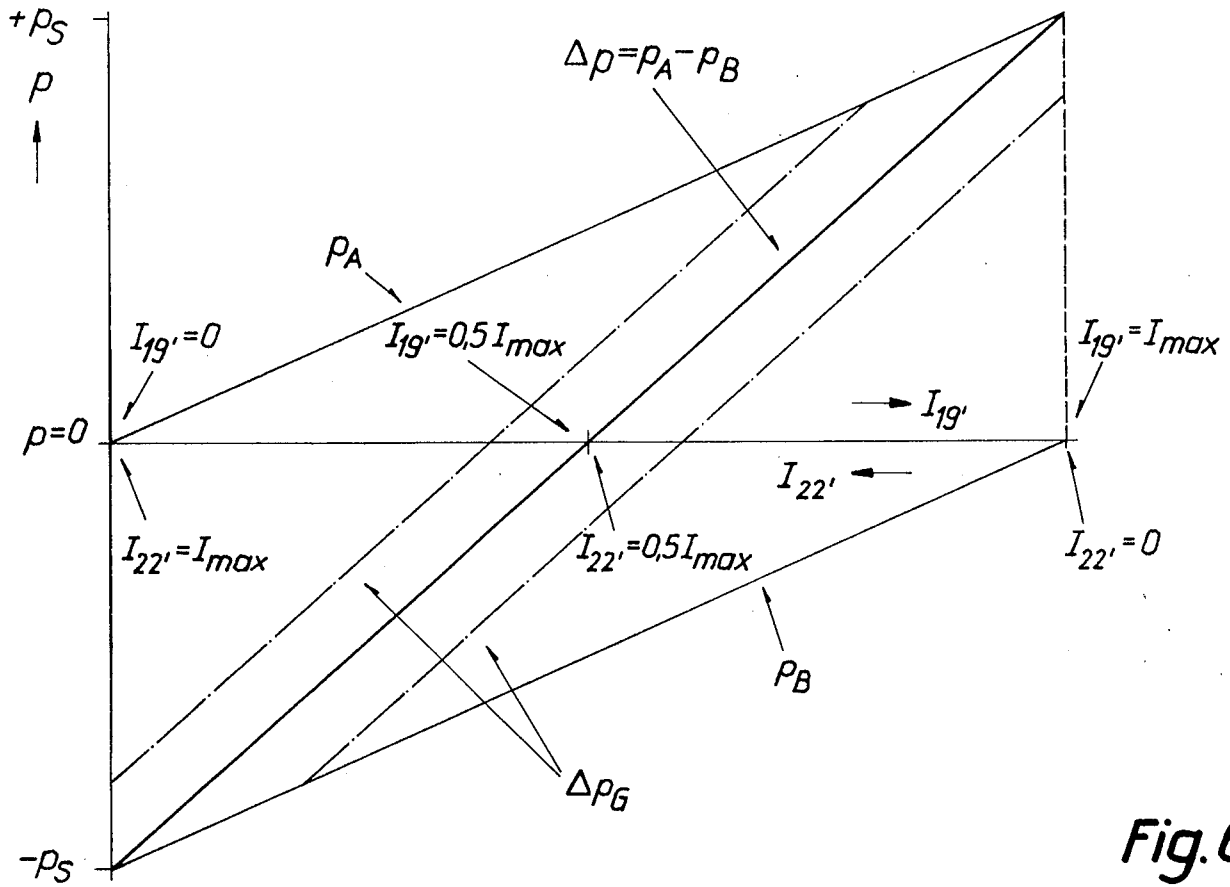
FIG. 6 is a diagram showing the variation of the pressures $P_A$, $P_B$ and $\Delta p$ in the bridge circuit of FIG. 2 as a function of the excitation degree of the associated electrohydraulic pressure-control valves.

As may be seen in the pressure variation diagram shown in FIG. 6 by way of example, the control values of fluid pressure or fluid flow velocity vary as a linear function of the degree of excitation of the electrohydraulic valves operating as pressure adjusting valves 19', 22'. In FIG. 6, the pressure control characteristic is plotted in the first and fourth quadrant of the plane determined by the coordinates for the fluid pressure and the exciting current of the valves 19', 22'. The pressure is a dependent variable and plotted as the ordinate. Because the pressures $p_A$ and $p_B$ can be varied between zero and the system pressure $p_S$ in each of the two connections A and B and act on operated device 15 in opposite directions, the flow direction from the connection A toward the connection B has been taken as positive.

The horizontal axis is provided with two scales for the exciting currents $I_{19}$, and $I_{22}$, of the two valves 19', 22', which scales are identical but graduated in opposite directions. The scale for the current $I_{19}$, belongs to the first and the scale for the current $I_{22}$, to the fourth quadrant. The current $I_{19}$, increases from its zero value in the origin to the right in the direction of the horizontal axis up to maximum value of $I_{max}$. The current $I_{22}$ has the same maximum value $I_{max}$ in the origin and decreases in the right-hand direction down to zero.

This representation is consistent with the fact that the production of the differential pressure $\Delta p = p_A - p_B$ for a reversibly operated device 15 is possible only if pressures of mutually opposite directions are adjusted in the valves 19' and 22'. An adjustment at which the two mutually coupled sliders 271', 321' of the potentiometers 27', 32' are simultaneously positioned in the midpoint of the control range, with the result that $I_{19'} = I_{22'} = 0.5\ I_{max}$, produces identical degrees of excitation in the values 19' and 22' and pressures $p_A$ and $p_B$ in the connections A and B, which are of equal value but of opposite direction with respect to the operated device 15. Consequently, in this case, the resulting differential pressure $\Delta p$ acting on the operated device is zero and the device is blocked in a rest position between the two balanced individual pressures $p_A$ and $p_B$.

To bring about a motion in the operated device, which may be designated as positive or negative in accordance with the flow direction from A to B or, inversely, from B to A, a differential pressure $\Delta p$ effective in the respective direction must be produced between the connections A and B. To this end, by actuating switch 37, the sliders 271' and 321' are moved from their middle standstill position to the respective control range sides of the potentiometers 27', 32' corresponding to the desired direction of the $\Delta p$-action. This entrains a mutually opposite change of excitation in the valves 19', 22' causing a corresponding opposite pressure variation in connections A and B along two straight-line characteristics, designated $p_A$ and $p_B$. Under the action of the thus produced differential pressure $\Delta p = p_A - p_B$, operated device 15 is put in motion in the direction corresponding to the sign of $\Delta p$.

The required magnitude of the driving difference-pressure, depending on the load of the operated device 15, is controllable along a straight control-line $\Delta p$ extending between two system-pressure values $+p_S$ and $-p_S$ alternately adjustable in the connections A and B and intersecting the horizontal axis ($p = 0$) centrally at the point $I_{19'} = I_{22'} = 0.5\ I_{max}$ corresponding to the standstill, the $\Delta p$-values being proportional to the currents $I_{19}$, and $I_{22}$, which increase or decrease in mutually opposite directions along this axis. The operated device effects a working motion exactly defined and guided by the two opposite pressures $p_A$ and $p_B$. The two associated values $p_A$, $p_B$ for each simultaneous position of the two potentiometers 27', 32' lie on a common ordinate from which the produced differential presssure $\Delta p$ may directly be read.

If the mutual position of the potentiometer sliders 271', 321' is changed while maintaining the rigid coupling described hereinbefore, in the diagram, the straight line characterizing $\Delta p$ is displaced, within the parallelogram limited by the lines $p_A$ and $p_B$ and the two ordinates of the values $+p_S$ and $-p_S$, as indicated by a dotted line and on the $y$-axis, respectively. This displacement moves the $\Delta p$-line, parallel to its initial position, to the right or left depending on whether the change of the mutual position of the sliders 271', 321' is made at the upper or lower limit of the potentiometers 27', 32'.

The dash-dotted straight lines $\Delta p_G$ at the right-hand and left-hand side of the solid $\Delta p$ -line indicate two possible positions of the latter resulting from a change of the slider position at the upper and lower limit of the potentiometers 27', 32', by the same definite distance which, in itself, may be freely chosen. Proportionally to this change, the range of the continuous $\Delta p$ -control in both of the motion directions is symmetrically limited. The values $p_A$ and $p_B$ associated with each other lie on separate ordinates.

It is, of course, possible to control the pressures in the connections A and B in following the respective $\Delta p$-line separately in the two directions. If, for example, it is necessary to control only the pressure $p_A$, the pressure $p_B$ must be zero. In consequence, the valve 11' is closed and the counterpressure, which is built up by the pressure fluid leaving operated device 15 for opening valve 12' at the outlet side, has only to surmount the resistance of the spring 112 (corresponding to a pressure of, for example, 7 kp/cm²). On the contrary, should only the pressure $p_B$ be controlled, the pressure $p_A$ must be zero.

The design of the electrohydraulic control circuit III shown in FIG. 7, and intended for automatic positioning of a load or for controlling the working speed, is based on the bridge circuit II as represented in FIG. 2 comprising antiparallel excitable pressure adjusting valves 19', 22'. The representation of the load and of some components of the valve arrangement known from FIG. 2 has been omitted for reasons of clarity. The component parts designated by the same reference numerals have already been described above.

A set value transmitter 300, for the exciting currents $I_{19}$, $I_{22}$, in the valves 19', 22' producing proportional aadjusted pressures $p_A$, $p_B$, and a position or speed transmitter 301, coupled to operated device 15 as a measuring transducer, are connected, through separate lines 302, 303, before a controller 304 which is designed as a sampled-data controller. Through another line 305, the controller 304 is connected to a reversing switching device 306 shown in FIG. 8. The switching device 306 is also connected, through lines 35, 36, to voltage source 24 and, through lines 38, 39 and 40, 41 to potentiometer drives 272, 322.

The parallel cross-dashes marked on the lines 302, 303, 305 in FIG. 7 indicate the number of wires. While the lines 302, 303 are two-wire lines, the line 305 comprises one wire for each of the two pairs of switching relays E, G and F, H of the reversing switches 307, 308 of FIG. 8 which are associated with each rotational direction of the drives 272, 322, and a third wire which is conjointly connected to the four switching relays E to H of FIG. 8.

Figure 8:
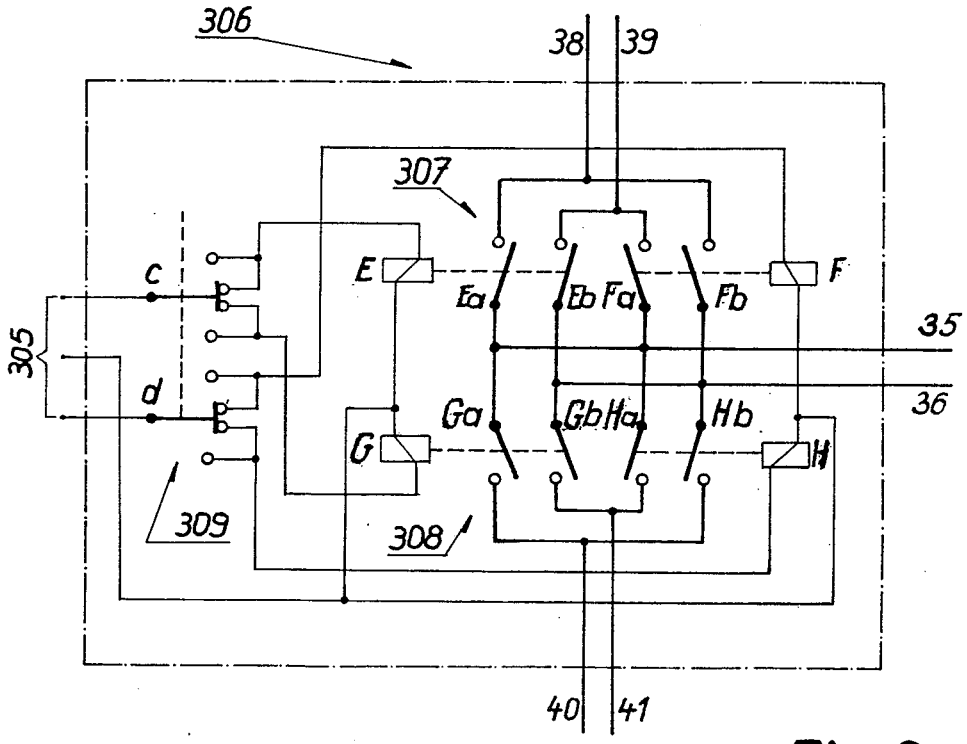
FIG. 8 is a circuit diagram of a reversing switching device for connecting the motor potentiometers in an electrohydraulic control circuit having a linear control characteristic.

In the reversing switching device 306 shown in FIG. 8, a reversing switch 307 or 308 is provided for each of the drives 272, 322. Each reversing switch 307, 308 comprises two switching relays E, F or G, H each associated to one rotational direction of the respective drives 272, 322. Each switching relay E, F, G. H actuates two respective contacts E*a* and E*b*, F*a* and F*b*, G*a* and G*b*, H*a* and H*b*, for permitting the polarity of the supply voltage for the drives 272, 322 to be changed and thereby the direction of rotation to be reversed. By means of a built-in change-over switch 309, a signal arriving from the controller 304 can be directed, according to the position of the switch, either conjointly to the two reversing switches 307, 308 or selectively to only one of them as a switching command. For transmitting the switching commands, delivered separately for the two directions, in accordance with the reversing operation from the controller 304, to the respective switching relays E, G and F, H of the reversing switches 307, 308, the changeover switch 309 comprises two movable contacts or contact arms *c*, *d* and can be operated manually or electromagnetically by remote control.

The control circuit is further formed by the adjusting system, i.e. potentiometers 27', 32', electric lines 28, 29, and 33, 34, valves 19', 22', lines 17, 18' and 20', 21 of the hydraulic pilot control, main control valves 9', 10 and 11', 12 with the associated bridge arms 5, 6 and 7, 8, connections A and B, and connections lines 13 and 14 leading back to operated device 15 (see FIG. 2).

As is known, the sampled-data controller constituting the controller 304 is a digital unit. As soon as a certain adjustable deviation between the set value and the actual value of the controlled variable (response threshold) is exceeded, a switch-on command passes from the controller 304 to the respective two switching relays E, G, or F, H of the reversing switches 307, 308 which are associated with the rotational direction of the potentiometer drives 272, 322 to be actuated for nullifying the deviation (contacts *d*, *d* of the change-over switch 309 in mid-position). A displacement of sliders 271', 321' started in this manner results in mutually opposite changes of the pressure $p_A$ and $p_B$, as explained in connection with FIG. 6. The differential pressure varying along the straight line Δp in FIG. 6 tends to eliminate the deviation.

If the deviation falls below the adjusted response threshold, the output of the controller tilts into the voltage-free state and switches the drives 272, 322 off by de-energizing the previously actuated switching relays.

It is also possible to provide a speed or pressure control separately for the two directions by switching the change-over switch 309 from the mid-position into one of its end positions. In this case, in accordance with the position of contacts *c*, *d*, the switching commands arriving from controller 304 can actuate either only switching relays E, F of the reversing switch 307 or only switching relays G, H of the other reversing switch 308, and thereby put in operation only the respective one of the potentiometer drives 272, 322.

The speed follows the shape of one of the straight lines $p_A$ or $p_B$ of FIG. 6 depending on which of the drives 272, 322 or connections A, B is included in the control. Also, in this case, the pressure $p_A$ or $p_B$ in the associated connection A or B is to be reduced to zero, by a manual actuation of the respective other drive 322 or 272, which is disconnected from the control circuit III.

The arrrangement of two identical electrohydraulic control circuits IV according to FIG. 9 is also based on the bridge circuit II shown in FIG. 2 and comprising pressure adjusting valves 19', 22' with individual excitation, bridge circuit II being connected as belonging to both of the control circuits IV as a common final control element for operated device 15. This arrangement is intended for an independent control of the pressures $p_A$, $p_B$ in the connections A, B in accordance with separate set-value programs of any desired shape. For a better understanding, the representation is analogous to that of FIG. 7 and the not-shown component parts of the circuits are assumed to be known.

Each of the identical control circuits IV is comparable with the respective half of control circuit III shown in FIG. 7 for separate control in the two directions and comprising, in each case, the respective bridge branch 5, 6 or 7, 8 of bridge circuit II in accordance with FIG. 2. However, the two control circuits IV are independent of each other and have their own control members. They are intended to operate simultaneously, but an individual operation of each of the circuits IV is also possible.

The control members of the two circuits IV and the component parts correspond to those of the control circuit III shown in FIG. 7, except for the following differences.

Two presssure sensors 301' are used as transducers, one being connected to the connection A and the other to the connection B.

Each of the two control circuits IV has its own reversing switch 309' which is identical with the switches 307, 308 of the reversing switching device 306 shown in FIG. 8.

The resulting differential pressure $\Delta p$, or the working speed, may be controlled, following the pre-setting of the two required values, in accordance with characteristics having any desired shape and largely adapted to the actual service conditions. This kind of control makes it possible to adjust any point within the parallelogram formed by the control lines $p_A$ and $p_B$ and the two limiting ordinates $+p_S$ and $-p_S$ shown in FIG. 6 (surface control).

While specific embodiments of the invention have been shown and described in detail to illustrate the application of the principles of the invention, it will be understood that the invention may be embodied otherwise without departing from such principles.

What is claimed is:

1. In a valve arrangement including four main control valves connected in respective arms of a bridge circuit for controlling a reversible hydraulically operated device, with the bridge circuit being connected, at one end of a first diagonal, to a source of fluid under pressure and, at the other end of its first diagonal, to a fluid reservoir, and being connected, at opposite ends of a second diagonal, to inlet and outlet ports of the operated device, the valve arrangement including respective pilot-control equipments each operatively associated with a respective pair of the main control valves for determining the direction and magnitude of the fluid pressure: the improvement comprising, in combination, four pressure-controlled valves constituting said main control valves and continuously pilot-controllable; each pilot control equipment comprising a respective pressure adjusting valve; and respective control lines connecting each pressure adjusting valve to a respective pair of main control valves.

2. An improved pilot-control equipment, as claimed in claim 2, in which said main control valves are pilot-controlled pressure limiting valves each mounted in one of the four arms of said bridge circuit; said main control valves being arranged in two pairs each connected to a respective pressure adjusting valve, and each pair of main control valves including two valves in opposite arms of said bridge circuit.

3. An improved pilot-control equipment, as claimed in claim 1, in which said main control valves mounted in two of said bridge arms which are adjacent the connection to said source of fluid under pressure are pilot-controlled pressure reducing valves, and said main control valves mounted in the two remaining bridge arms which are adjacent the connection to said reservoir are pilot-controlled pressure limiting valves; each main control valve being biased by a spring and the springs biasing the pressure reducing valves having a smaller spring constant than the springs biasing the pressure limiting valves; each pair of said main control valves including a respective pressure reducing valve and a respective pressure limiting valve conjointly forming a bridge branch, which is connected to a respective one of said pressure adjusting valves.

4. An improved pilot-control equipment, as claimed in claim 3, including respective first and second connection lines connecting first and second opposite ends of the second diagonal of said bridge circuit to inlet and outlet ports of the operated device; a first pilot-controled check valve in said first connection line; a second pilot-controlled check valve in said second connection line; a first control line connecting said first check valve to said second end of said second diagonal; and a second control line connecting said second check valve to said first end of said second diagonal.

5. An improved pilot-control equipment, as claimed in claim 1, in which said pressure adjusting valves are electrohydraulic pressure control valves continuously adjustable between a closed and a fully open position; a source of electric potential; and a respective potentiometer operatively associated with each electrohydraulic pressure control valve and connected to said electric potential source for adjusting the exciting current of the associated electrohydraulic pressure-control valve.

6. An improved pilot-control equipment, as claimed in claim 5, in which each potentiometer has an associated adjustable tap; and means mechanically interconnecting said taps.

7. An improved pilot-control equipment, as claimed in claim 5, in which each potentiometer has an associated adjustable tap; and means electrically connecting said taps.

8. An improved pilot-control equipment, as claimed in claim 5, in which each potentiometer has an associated adjustable tap; means coupling said taps for parallel displacement in respective opposite directions, with the respective relative positions of the taps during such displacement being fixed in a manner such that, if the movement of one tap starts from an extreme position on its associated ptentiometer having the highest electrical potential, the movement of the other tap starts from the extreme position on its potentiometer having the lowest electric potential and that, in the course of the displacement of said taps, said taps pass through the middle point of the control range of said potentiometers simultaneously.

9. An improved pilot-control equipment, as claimed in claim 5, in which each potentiometer has an associated adjustable tap; means coupling said adjustable taps for conjoint displacement in parallel relation to each other in opposite directions; said coupling means coupling said taps so that their relative positions during such displacement are fixed, with said taps starting from positions, on their respective potentiometers, having different electric potentials in a manner such that said taps pass through the middle point of the control range of said potentiometers at different time points.

10. An improved pilot-control equipment, as claimed in claim 5, in which each potentiometer has a respective adjustable tap; said adjustable taps being displaceable independently of each other.

11. An improved pilot-control equipment, as claimed in claim 5, in which each potentiometer includes an associated adjustable tap, said adjustable taps being adjustable in parallel opposite directions relative to each other; said main control valves of said bridge circuit comprising two pilot-controlled pressure reducing valves mounted in the two bridge arms adjacent the bridge connection to said source of fluid under pressure, and two pilot-controlled pressure limiting valves mounted in the two bridge arms adjacent the bridge connection to said reservoir; respective biasing springs operatively associated with each main control valve; the biasing springs of said pressure reducing valves having a smaller spring constant than the biasing springs of said pressure limiting valves; each said pair of main control valves comprising a respective pressure reducing valve and a respective pressure limiting valve forming a respective bridge branch; said bridge circuit forming a final control element of an electrohydraulic control circuit having a linear control characteristic $\Delta p$; said electrohydraulic control circuit including a set value transmitter for the anti-parallel excitation of said pressure adjusting valves, a condition transmitter coupled to said operated device, and a controller having an input connected to said set value transmitter and to said condition transmitter; a respective drive for each potentiometer; and a three-position reversible switch connected to the output of said controller and operable selectively to connect the controller output to both potentiometer drives or to a selected one of said potentiometer drives.

12. An improved pilot-control equipment, as claimed in claim 5, in which each potentiometer includes an associated adjustable tap, said adjustable taps being adjustable in parallel opposite directions relative to each other; said main control valves of said bridge circuit comprising two pilot-controlled pressure reducing valves mounted in the two bridge arms adjacent the bridge connection to said source of fluid under pressure, and two pilot-controlled pressure limiting valves mounted in the two bridge arms adjacent the bridge connection to said reservoir; respective biasing springs operatively associated with each main control valve; the biasing springs of said pressure reducing valves having a smaller spring constant than the biasing springs of said pressure limiting valves; each said pair of main control valves comprising a respective pressure reducing valve and a respective pressure limiting valve forming a respective bridge branch; said respective branches being designed as two identical electrohydraulic control circuits, and said bridge circuit forming a common final control element for said operated device and the resulting control characteristic $\Delta p$ having any selected shape; each of said identical electrohydraulic control circuits including a set value transmitter for separate excitation of the associated pressure adjusting valves, a pressure sensor associated with said first and second opposite ends of the second diagonal of said bridge circuit, and a controller having an input connected to the associated set value transmitter and to the corresponding pressure sensor; respective drives for each of said potentiometers; and respective reversing switches each connecting the output of the associated controller to the associated potentiometer drive.

* * * * *